US006386745B1

(12) United States Patent
Horiba

(10) Patent No.: US 6,386,745 B1
(45) Date of Patent: May 14, 2002

(54) VEHICLE LAMP FIXTURE

(75) Inventor: Takeshi Horiba, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/512,101

(22) Filed: Feb. 24, 2000

(30) Foreign Application Priority Data

Feb. 25, 1999 (JP) ..... 11-049157

(51) Int. Cl.[7] ..... F21V 5/00

(52) U.S. Cl. ..... 362/520; 362/509; 362/539; 362/307; 362/311; 362/351; 362/255; 362/331; 362/528

(58) Field of Search ..... 362/509, 539, 362/307, 311, 351, 255, 520, 331, 528

(56) References Cited

U.S. PATENT DOCUMENTS 4,814,950 A * 3/1989 Nakata ..... 362/331
5,199,779 A * 4/1993 Sato ..... 362/297
5,556,190 A 9/1996 Saijo
5,707,134 A 1/1998 Nishizawa
5,782,550 A 7/1998 Ohashi et al.
5,908,239 A * 6/1999 Sugimoto ..... 362/528.5
6,000,814 A * 12/1999 Nestell et al. ..... 362/520
6,129,447 A * 10/2000 Futami ..... 362/539

* cited by examiner

*Primary Examiner*—Stephen Husar
*Assistant Examiner*—Guiyoung Lee
(74) *Attorney, Agent, or Firm*—Koda & Androlia

(57) ABSTRACT

A vehicle lamp fixture in which a reflector is housed in a lamp body, a transparent front lens is attached to the lamp body, and a non-transparent treatment is applied to a region near a seal leg of a front lens. The non-transparent treatment is done by forming a plurality of convex cylindrical lens elements in a striped pattern on the entire region of the outer peripheral side and on a predetermined region of the inner peripheral side of the seal leg of the rear and/or front surface of the front lens, thus preventing a gap between the reflector and the lamp body from appearing dark when viewing the lamp fixture from the front and also preventing a seal groove of the lamp body from being directly seen.

7 Claims, 4 Drawing Sheets

VEHICLE LAMP FIXTURE

BACKGROUND OF THE INVENTION

1. Field of the Invention

The present invention relates to a vehicle lamp fixture wherein a reflector is housed in a lamp body and a transparent front lens is attached to the lamp body.

2. Prior Art

Vehicle lamp fixtures include, among others, a moveable reflector type front lamp and an indicator lamp. In the moveable reflector type front lamp, a reflector is housed in a lamp body so as to be tiltable, and the indicator lamp generally has an inner reflector type reflector. In these lamp fixtures, a gap is inevitable between the reflector and the lamp body, and this gap appears dark when the lamp fixture is viewed from the front. When the front lens is transparent, the darkness of this gap is directly seen from the front of the fixture, giving the vehicle lamp fixture an extremely poor external appearance.

Therefore, an extension reflector or the like has been used to block such a gap between the reflector and the lamp body and improve the appearance of the lamp fixture.

However, providing an extension reflector or the like causes the problem of a proportional cost increase of the lamp fixture.

SUMMARY OF THE INVENTION

In view of the above, the object of the present invention is to provide a vehicle lamp fixture which improves the appearance of the lamp fixture at a low cost without requiring an extension reflector or the like.

The present invention achieves the foregoing object by a structure that prevents the gap between the reflector and the lamp body from being seen by the use of a non-transparency treatment applied to the region near the lamp body attachment portion of the front lens.

More specifically, the present invention is for a vehicle lamp fixture that comprises a light-source bulb, a reflector having a reflective surface which reflects the light from the light-source bulb forward, a lamp body which houses the reflector, and a transparent front lens attached to the lamp body so as to be in the front edge of the lamp body; and in the present invention, a non-transparency treatment is applied to a region which is near the lamp body attachment portion of the front lens.

The type of "vehicle lamp fixture" should not be limited to a particular lamp fixture. It refers to any type of lamp fixtures, including a front lamp such as a head lamp and a fog lamp and also an indicator lamp such as a tail lamp and a turn signal lamp.

The "non-transparent treatment" is performed so that the inside of the lamp fixture cannot be directly seen through the transparent front lens; and as far as this is satisfied, there is no limitation in the treatment range or treatment method. As a specific example of a treatment method, frost treatment, lens element forming treatment, painting treatment, and vacuum evaporation treatment and the like can be employed.

As seen from the above, in the vehicle lamp fixture according to the present invention, a reflector is housed in the lamp body, a transparent front lens is attached to this lamp body, and a non-transparent treatment is applied to the region near the lamp body attachment portion of the front lens. Accordingly, the gap between the reflector and the lamp body is prevented from appearing dark when the lamp fixture is viewed from the front.

Thus, the appearance of the lamp fixture is improved at a low cost without requiring that an extension reflector or the like be provided.

As described above, there is no limitation in the treatment range of the "non-transparent treatment." If the inner edge of the region in which the non-transparent treatment is applied is set to a position that substantially corresponds to the front peripheral edge of the reflector, not only is the gap prevented from appearing dark, but also the transparent area of the front lens can be ensured to the greatest extent possible. As a result, a sense of transparency of the lamp fixture is sufficiently maintained.

Generally speaking, in the vehicle lamp fixture, due to restrictions on, for instance, a space required for installation in the car body, a lamp body needs to have an extended portion which extends toward the front at least near the front edge portion of the lamp body. Also, a peripheral wall portion which extends toward the front from a reflective surface is often formed on the reflector. In view of these structural reasons, in the present invention, a part of the peripheral wall portion of the reflector which is located near an extended portion of the lamp body is formed as a reflector extended portion that extends toward the front of the lamp. By way of this structure, the following function and advantages are obtained:

With the reflector extended portion, the front edge of the reflector can be positioned close to the front end of the lamp body for the amount (or size) of the reflector extended portion; and it is possible to increase the area in which the non-transparent treatment is formed. Also, the reflector extended portion can conceal the back area of the gap between the reflector and the lamp body. Accordingly, the gap is even more effectively prevented from appearing dark.

DETAILED DESCRIPTION OF THE PREFERRED EMBODIMENTS

One embodiment of the present invention will be described with reference to the accompanying drawings.

Figure 1:
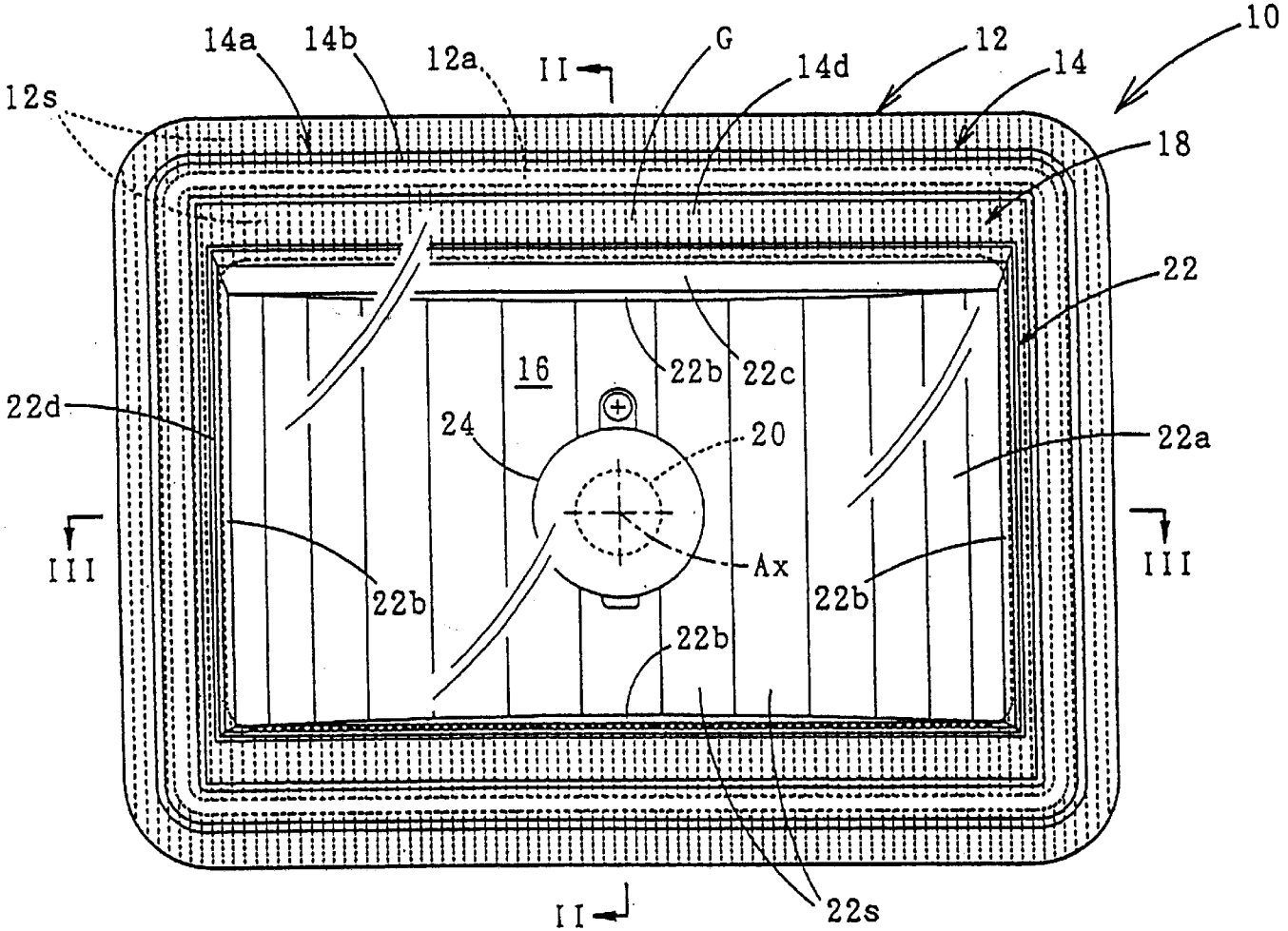
FIG. 1 is a front view of a vehicle lamp fixture according to one embodiment of the present invention.
Figure 2:
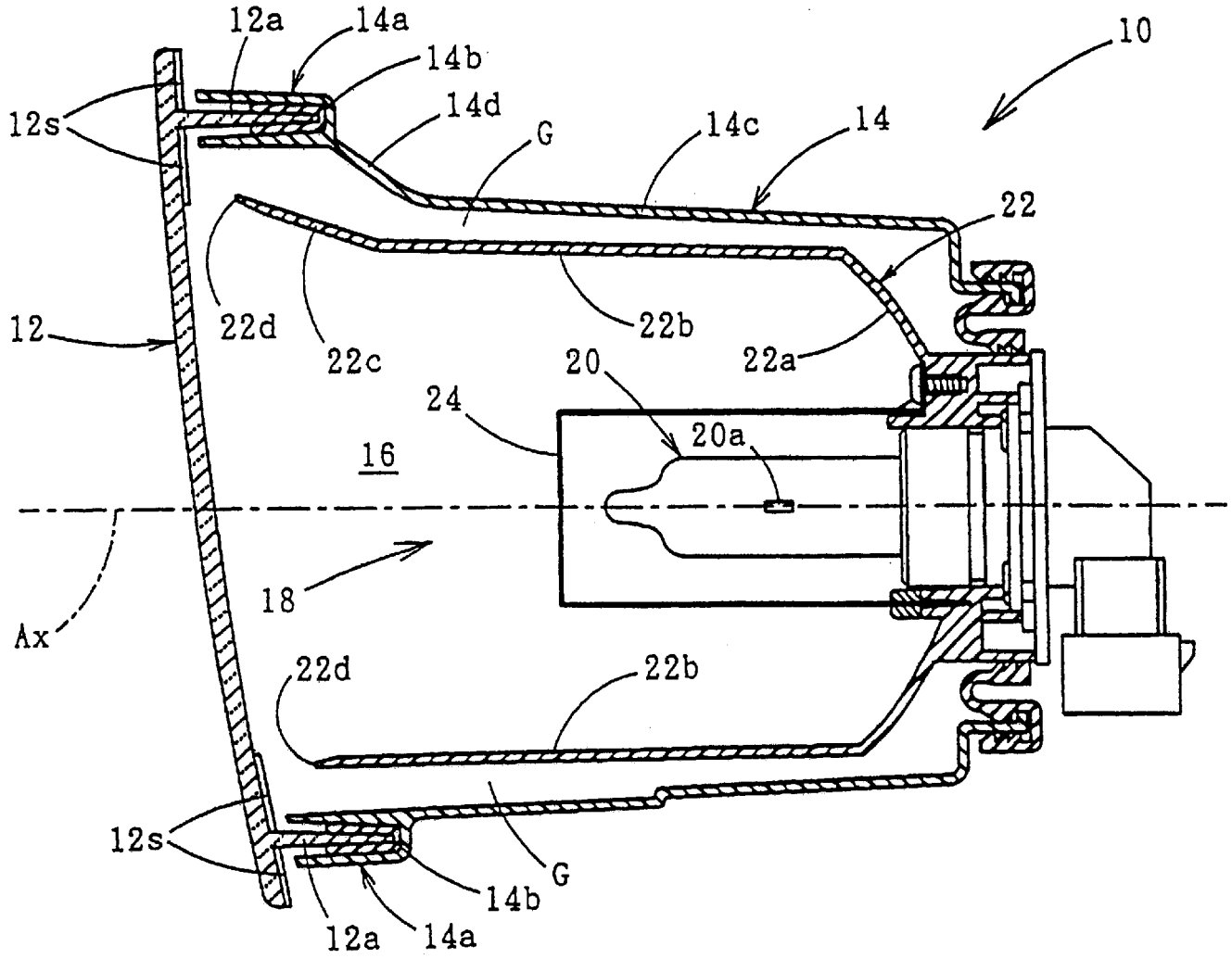
FIG. 2 is a cross-sectional view taken along the line II—II in FIG. 1.
Figure 3:
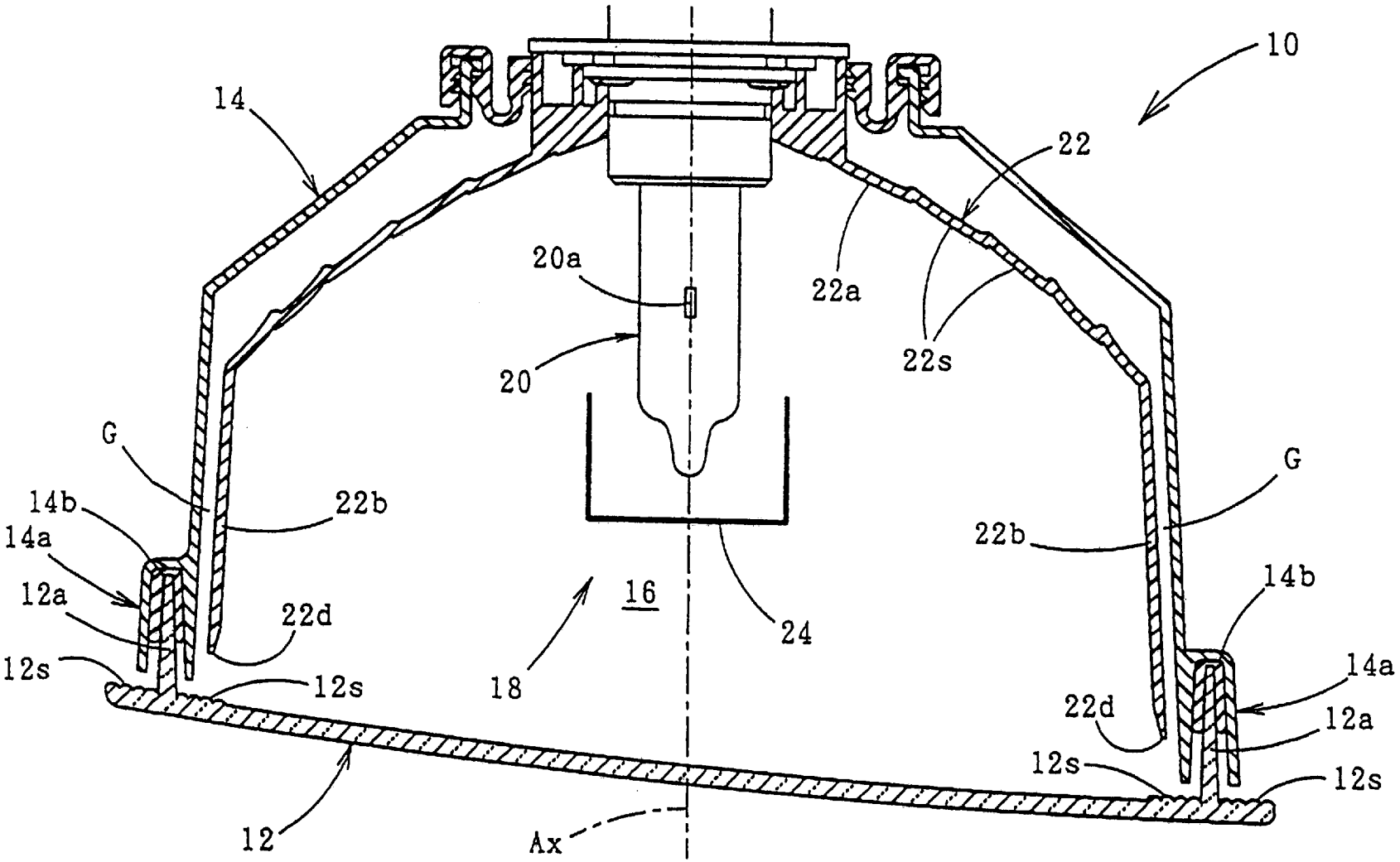
FIG. 3 is a cross-sectional view taken along the line III—III of FIG. 1.

The vehicle lamp fixture 10 according to one embodiment the present invention shown in FIGS. 1 through 3 is a moveable reflector type fog lamp. A reflector unit 18 of this lamp fixture or fog lamp 10 is provided in a vertically tiltable fashion in a lamp chamber 16 that comprises a front lens 12 and a lamp body 14.

The front lens 12 is attached to the lamp body 14 so that the lens 12 is located at a front edge portion 14*a* of the lamp body 14. An annular seal leg (or called "lamp body attachment portion") 12*a* is formed near the peripheral edge of the rear surface of the front lens 12. On the other hand, an annular seal groove 14*b* is formed in the front edge portion 14*a* of the lamp body 14. The front lens 12 is attached, using a seal agent, to the lamp body 14 with its seal leg (or the lamp body attachment portion) 12*a* inserted into the seal groove 14*b* of the front edge portion 14*a* of the lamp body 14.

The front lens 12 is transparent, and a non-transparent treatment is applied to the region near the seal leg 12*a* thereof. More specifically, as best seen from FIG. 3, on the rear surface of the front lens 12, a plurality of convex cylindrical lens elements 12*s* are formed in a striped pattern at a predetermined pitch on the entire region of the outer peripheral side and on a predetermined region (the specific range of the application of the lens elements 12*s* will be described below) of the inner peripheral side of the seal leg 12*a*.

The upper wall portion 14*c* of the lamp body 14 is formed so as to be at a lower position with respect to its front edge portion 14*a* so as to avoid interfering with structural objects of the car body. The upper wall portion 14*c* is provided with a lamp body extended portion 14*d* that, near the front edge portion 14*a*, extends upward to the front.

The reflector unit 18 comprises a light-source bulb 20, a reflector 22 and a shade 24.

The light-source bulb 20 is, for instance, a halogen bulb that has a so-called C-8 type filament 20*a* and is attached to the reflector 22. The light bulb 20 is aligned on the lamp fixture reference axis Ax.

The reflector 22 has a reflective surface 22*a* is provided with a plurality of striped reflective elements 22*s* formed on the paraboloid of revolution wherein the axis of the paraboloid tilts somewhat down and to the front with respect to the lamp fixture reference axis Ax. The reflective surface 22*a* diffuses, deflects and reflects the light from the light-source bulb 20 to the front.

The shade 24 is fixed with a screw to the reflector 22 so that it surrounds the light-source bulb 20 and covers a predetermined area of the light-source bulb 20.

The reflector 22 further has a peripheral wall portion 22*b* formed around the reflective surface 22*a*. The peripheral wall portion 22*b* is provided on the entire periphery of the reflective surface 22*a* and extends to the front from the peripheral edge of the reflective surface 22*a*. The portion near the lamp body extended portion 14*d* is a reflector extended portion 22*c* that extends upward toward the front. The front peripheral edge 22*d* of this reflector extended portion 22*c* is, as best seen from FIG. 2, positioned somewhat higher than the rear edge of the lamp body extended portion 14*d* (that is, the front edge of the upper wall portion 14*c*).

The inner edge of the region in which the convex cylindrical lens elements 12*s* are formed is set so as to substantially correspond to the front peripheral edge 22*d* of the reflector 22 when viewing the lamp fixture from the front.

In the thus structured vehicle lamp fixture 10, the reflector 22 is housed in the lamp body 14, the transparent front lens 12 is attached to the lamp body 14, and the convex cylindrical lens elements 12*s* are formed in the regions near the seal leg 12*a* that projects on the rear surface of the front lens 12. Accordingly, because of the convex cylindrical lens elements 12*s*, the gap G between the reflector 22 and the lamp body 14 is prevented from appearing dark when the lamp fixture is viewed from the front.

Thus, the appearance of the lamp fixture can be improved at a low cost without requiring an extension reflector or the like to be provided as in the past.

The vehicle lamp fixture 10 is, as described above, a movable reflector type fog lamp; and the reflector unit 18 tilts in a vertical direction. Though the gap G between the peripheral wall portion 22*b* of the reflector 22 and the lamp body 14 is relatively large on both the upper and lower sides of the reflector 22 in this movable reflector type fog lamp, the appearance of the lamp is extremely improved because of the convex cylindrical lens elements 12*s*.

The inner edge of the region in which the convex cylindrical lens elements 12*s* are formed is set so as to substantially correspond to the front peripheral edge 22*d* of the reflector 22 when the lamp fixture is viewed from the front. Accordingly, in addition to preventing the gap G from appearing dark, it is further possible to allow the size of the area of the transparent portion of the front lens 12 to the greatest extent possible. Thus, a sense of transparency of the lamp fixture is sufficiently maintained.

Furthermore, the upper wall portion 14*c* of the lamp body 14 has the lamp body extended portion 14*d* which extends upward and toward the front near the front edge portion 14*a*. Since the peripheral wall portion 22*b* of the reflector 22 has the reflector extended portion 22*c* which extends upward and toward the front, the front peripheral edge 22*d* of the reflector 22 can be located near the front edge portion 14*a* of the lamp body 14. Thus, the region formed with the convex cylindrical lens elements 12*s* (that cover the gap G) can be made as small as possible. Furthermore, since the reflector extended portion 22*c* is provided, it is possible to prevent the back area of the gap G from being seen; and the gap is even more effectively prevented from appearing dark.

Also, the convex cylindrical lens elements 12*s* are formed not only on the inner peripheral side of the seal leg 12*a* of the front lens 12 but also on the entire region of the outer peripheral side thereof. Accordingly, the seal groove 14*b* of the lamp body 14 is not directly seen when the lamp fixture is viewed from the front, and the appearance of the lamp fixture can be further improved.

In the above-describe embodiment, the transparent portion of the front lens 12 is entirely transparent; but some decorative relieves or the like can be formed in the transparent portion.

Also, in the above embodiment, the convex cylindrical lens elements 12*s* are formed in a stripe pattern. In addition to this convex shape lens elements, concave cylindrical lens elements, waveform lens elements, fisheye lens elements, micro-irregularities, and the like can be formed instead of the convex cylindrical lens elements 12*s* for accomplishing the object of the present invention. Also, these lens elements or the like may be formed on the front surface, instead of the rear surface, of the front lens 12.

Figure 4:
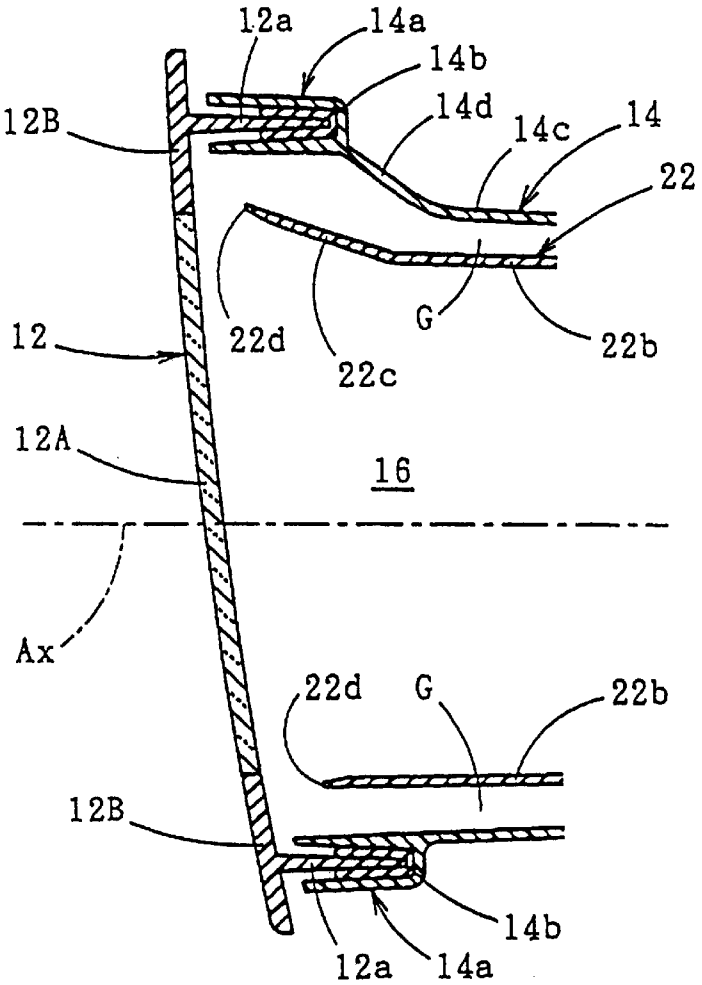
FIGS. 4(*a*) and 4(*b*) are cross-sectional views of the essential portion of a modified examples of the present invention.
Figure 4:
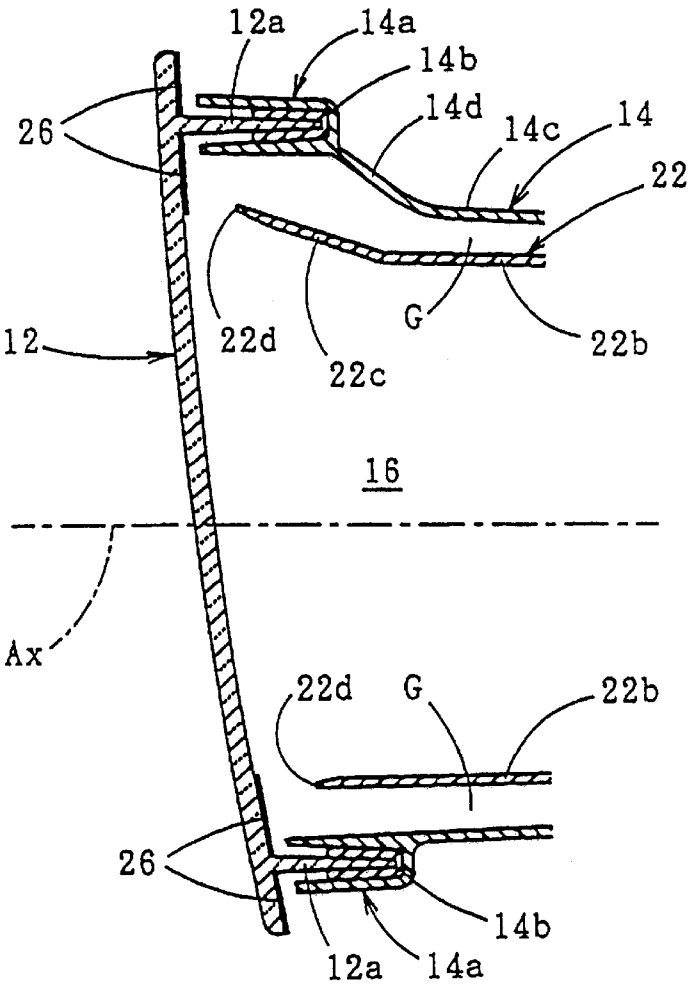

Furthermore, in the present invention, instead of the lens elements and the like which are provided as a non-transparent treatment, a shade cover 26 with a surface treatment of smoke paint or the like, as shown in FIG. 4(*a*), can be formed in the region near the seal leg 12*a* of the rear or the front surface of the front lens 12. Furthermore, as shown in FIG. 4(*b*), the front lens 12 can be a combination lens composed of a transparent lens 12A and a non-transparent lens 12B which surrounds the transparent lens 12A.

What is claimed is:

1. A vehicle lamp fixture comprising a light-source bulb, a movable reflector having a reflective surface provided on the paraboloid of revolution which reflects light from said light-source bulb forward, a lamp body which houses said reflector, and a transparent front lens attached to said lamp body in a front edge portion of said lamp body, and wherein:

a non-transparency treatment is applied to a region near a lamp body attachment portion of said front lens, said lamp body has a lamp body extended portion which extends toward a front near said front edge portion, said reflector has peripheral wall portion that extends forward from an end portion of said reflective surface, and a part of said reflector which is near said lamp body extended portion of said peripheral wall portion has a reflector extended portion that extends toward said non-transparency treatment with a gap between said lamp body extended portion and said reflector extended portion, and said gap between said lamp body extended portion and said reflector extended portion is prevented from appearing dark when the lamp fixture is viewed from the front by said non-transparency treatment.

2. The vehicle lamp fixture according to claim 1, characterized in that an inner edge of an area to which said non-transparency treatment is applied substantially corresponds positionally to a front peripheral edge of said reflector.

3. The vehicle lamp fixture according to claim 1, characterized in that said non-transparency treatment is obtained by lens elements integrally formed on said front lens.

4. The vehicle lamp fixture according to claim 1, characterized in that said non-transparency treatment is obtained by paint applied to said front lens.

5. The vehicle lamp fixture according to claim 1, characterized in that said front lens comprises a transparent lens portion and a non-transparent lens portion that surrounds said transparent lens portion.

6. The vehicle lamp fixture according to claim 2, characterized in that said non-transparency treatment is formed on an entire region of an outer peripheral side of a seal leg formed on said front lens and on a predetermined region of an inner peripheral side of said seal leg.

7. The vehicle lamp fixture according to claim 3, wherein said lens elements are selected from the group consisting of convex cylindrical lens elements, concave cylindrical lens elements, waveform lens elements, fisheye lens elements, and lens elements with micro-irregularities.

* * * * *